US010072392B2

(12) United States Patent
Wittendorf

(10) Patent No.: US 10,072,392 B2
(45) Date of Patent: Sep. 11, 2018

(54) BOOM FOOT DESIGN WITH PROTRUDING FLANGES

(71) Applicant: DEERE & COMPANY, Moline, IL (US)

(72) Inventor: Gregory Wittendorf, Dubuque, IA (US)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 15/279,995

(22) Filed: Sep. 29, 2016

(65) Prior Publication Data

US 2018/0087235 A1 Mar. 29, 2018

(51) Int. Cl.
*E02F 3/38* (2006.01)
*E02F 3/32* (2006.01)

(52) U.S. Cl.
CPC ..... *E02F 3/382* (2013.01); *E02F 3/38* (2013.01); *E02F 3/32* (2013.01)

(58) Field of Classification Search
CPC ..... E02F 3/38
USPC ..... 414/727
See application file for complete search history.

(56) References Cited

U.S. PATENT DOCUMENTS 4,034,876 A 7/1977 Yancey
6,158,949 A * 12/2000 Walth ..... E02F 3/38 414/722
8,419,339 B2 * 4/2013 Okumura ..... E02F 3/382 414/723
9,121,163 B2 * 9/2015 Ditzler ..... E02F 3/38
2008/0187427 A1 * 8/2008 Durney ..... E02F 3/38 414/722
2010/0303541 A1 * 12/2010 Okumura ..... E02F 3/382 403/306
2017/0067224 A1 * 3/2017 Yamashita ..... E02F 3/38

FOREIGN PATENT DOCUMENTS

WO WO-2015186800 A1 * 12/2015 ..... E02F 3/38
WO WO2015186800 A1 12/2016

* cited by examiner

*Primary Examiner* — Gerald McClain
(74) *Attorney, Agent, or Firm* — Taft Stettinius & Hollister LLP; Stephen F. Rost

(57) ABSTRACT

A boom and boom foot section for connection to a machine, where the boom includes a center section and a box section extending between the foot and center sections. The box section includes first and second side walls. The foot section includes a machine connection for connecting the boom to the machine, and first and second protruding flanges. The first flange couples to the first side wall, and the second flange couples to the second side wall. The foot section can include a bulkhead. The machine connection, bulkhead, and flanges can be formed by a single piece of material. The flanges can be coupled to the side walls by weld joints that do not have weld roots. The flanges can extend beyond the bulkhead to allow internal welds in the weld joint. The flanges and side walls can have double-beveled edges for the weld joints formed by fused groove welds.

18 Claims, 4 Drawing Sheets

BOOM FOOT DESIGN WITH PROTRUDING FLANGES

FIELD OF THE DISCLOSURE

The present disclosure relates to machinery design, and more particularly to an improved boom foot design for a machine.

BACKGROUND

Some machines, for example an excavator, include an aft structural section often referred to as a boom. The aft structural section or boom can include a boom foot section connected to the upper frame of the machine, a boom center section and a boom nose section which provides a pinned attachment to an arm which is connected to a bucket or other tool. The boom foot is typically connected to the upper frame of the machine by a boom foot pin that passes through a boom foot casting or forging. The boom foot transmits boom loads to the upper frame of the machine. The transition from a tall box section of the boom (between the boom foot and center sections) to the boom foot pin connection to the upper frame occurs over a very short distance. During corner digging and side loading of the bucket, large torsional loads exist at a boom joint between the side sheets of the tall box section and the boom foot casting.

In traditional boom foot casting/forging designs, a separately welded bulkhead plate is added to aid the boom foot in resisting twist. In addition, traditional boom foot designs feature either a separately tacked backer strip joint to the side sheet, or a machined shelf on the casting or forging for the joint to the side sheet. In these designs, a weld root exists from which a crack can originate, especially under the large axial and bending loads present at the boom foot. Traditional boom foot designs use either thicker sections or external doublers at the boom foot, to lower stresses at the weld root to prevent crack propagation.

It would be desirable to have a boom foot design that helps resist twisting at the boom foot, that eliminates the weld root at the joint between the side sheets of the tall box section of the boom and the boom foot casting, and/or that resists cracking of the welded joint between the side sheets of the tall box section of the boom and the boom foot casting.

SUMMARY

A boom for a machine is disclosed, and a boom foot section is disclosed for a boom connected to a machine where the boom includes a boom center section and a box section extending between the boom foot section and the boom center section. The box section includes first and second side walls. The boom foot section includes a machine connection configured to connect the boom to the machine, and first and second protruding flanges. The first protruding flange is configured to be coupled to the first side wall of the box section of the boom, and the second protruding flange is configured to be coupled to the second side wall of the box section of the boom. The boom foot section can also include a bulkhead, where the first and second protruding flanges extend away from the machine connection beyond the bulkhead. The machine connection, the bulkhead, and the first and second protruding flanges can be formed by a single piece of material. The bulkhead can include an aperture configured for internal core removal from the boom foot section.

The first protruding flange can be coupled to the first side wall of the box section by a first weld joint, and the second protruding flange can be coupled to the second side wall of the box section by a second weld joint. The first and second weld joints can both be configured to not include a weld root. The first protruding flange can extend beyond the bulkhead sufficiently to allow a first internal weld and a first external weld to be fused to form the first weld joint, and the second protruding flange can extend beyond the bulkhead sufficiently to allow a second internal weld and a second external weld to be fused to form the second weld joint. The first and second protruding flanges can extend beyond the bulkhead sufficiently to allow a robot welder to perform the first and second internal welds of the first and second weld joints. The first protruding flange can have a double-beveled edge used in the first weld joint for connection to the first side wall, and the second protruding flange can have a double-beveled edge used in the second weld joint for connection to the second side wall.

The first side wall can have a double-beveled edge used in the first weld joint, and the second side wall can have a double-beveled edge used in the second weld joint. The double-beveled edges of the first side wall and the first protruding flange can form a first interior V-groove and a first exterior V-groove, and the first weld joint can be formed in the first interior and exterior V-grooves. The double-beveled edges of the second side wall and the second protruding flange can form a second interior V-groove and a second exterior V-groove, and the second weld joint can be formed in the second interior and exterior V-grooves. The first weld joint can include a first groove weld formed in the first interior V-groove and a second groove weld formed in the first exterior V-groove where the first and second groove welds are fused to form the first weld joint. The second weld joint can include a third groove weld formed in the second interior V-groove and a fourth groove weld formed in the second exterior V-groove where the third and fourth groove welds are fused to form the second weld joint.

BRIEF DESCRIPTION OF THE DRAWINGS

The above-mentioned aspects of the present disclosure and the manner of obtaining them will become more apparent and the disclosure itself will be better understood by reference to the following description of the embodiments of the disclosure, taken in conjunction with the accompanying drawings, wherein.

Corresponding reference numerals are used to indicate corresponding parts throughout the several views.

DETAILED DESCRIPTION

The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure.

Figure 1:
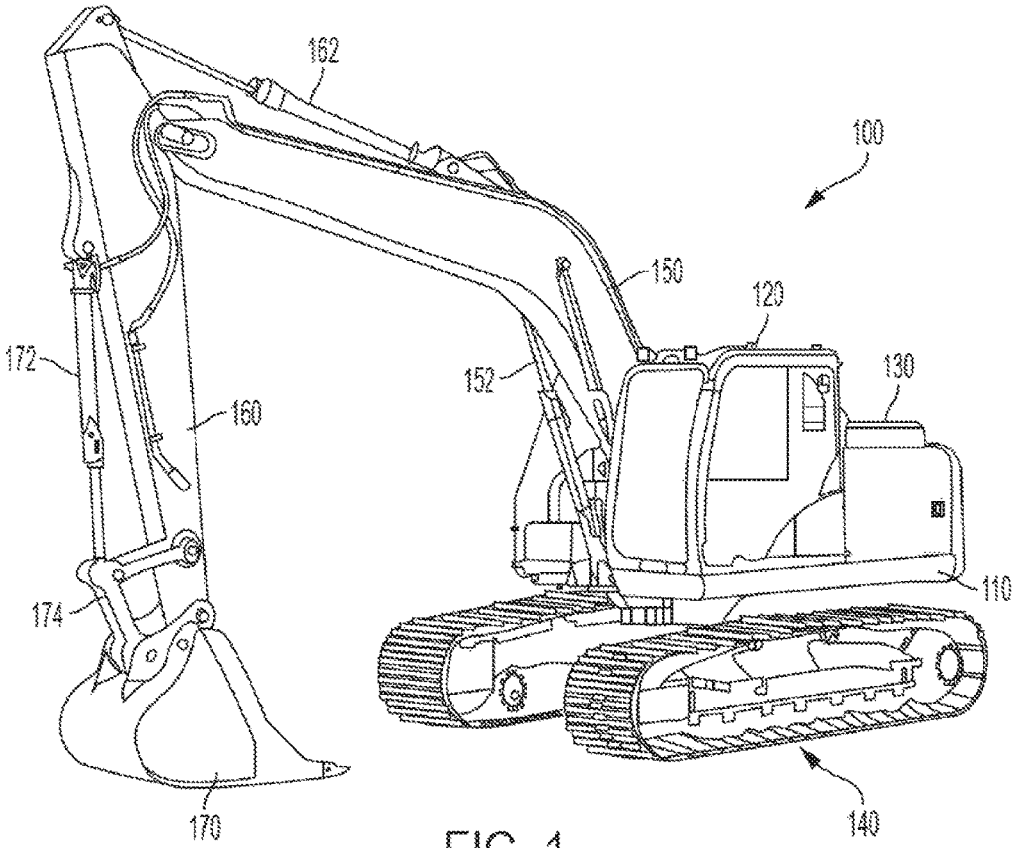
FIG. 1 illustrates an exemplary machine, an excavator, with a boom.

FIG. 1 illustrates an exemplary excavator 100 comprising a frame 110, an operator cab 120, an engine compartment and counterweight 130, traction devices 140, a boom 150, an arm 160 and a bucket 170. The operator cab 120, engine compartment and counterweight 130 and traction devices 140 are coupled to the frame 110. A proximal end of the boom 150 is pivotally coupled to the frame 110 and a distal end of the boom 150 is pivotally coupled to the arm 160. A proximal end of the arm 160 is pivotally coupled to the boom 150 and a distal end of the arm 160 is pivotally coupled to the bucket 170. A boom cylinder 152 has a proximal end coupled to the frame 110 and a distal end coupled to the boom 150. The boom cylinder 152 can be used to raise and lower the boom 150. An arm cylinder 162 has a proximal end coupled to the boom 150 and a distal end coupled to the arm 160. The arm cylinder 162 can be used to raise and lower the arm 160. A bucket cylinder 172 has a proximal end coupled to the arm 160 and a distal end coupled to bucket linkage 174 that is coupled to the bucket 170. The bucket cylinder 172 and bucket linkage 174 can be used to move the bucket 170.

Figure 2:
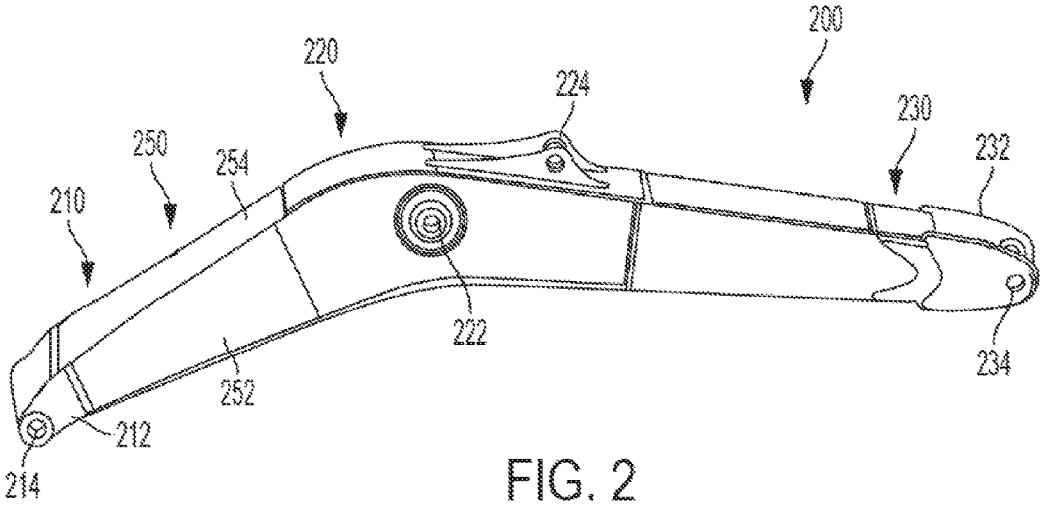
FIG. 2 PRIOR ART
FIG. 2 illustrates an example of an existing excavator boom that includes a boom foot section, a boom center section and a boom nose section.

FIG. 2 shows an example of an existing excavator boom 200 that includes a boom foot section 210, a boom center section 220 and a boom nose section 230. The boom foot section 210 includes a boom foot casting 212 that includes a foot pin aperture 214 where a boom foot pin can be inserted to pivotally connect the boom 200 to the frame 110 of the excavator 100. The boom center section 220 includes a boom cylinder connection 222 for coupling the boom cylinder 152 to raise and lower the boom 200, and an arm cylinder connection 224 for coupling the arm cylinder 162 to raise and lower the excavator arm 160. The boom nose section 230 includes a nose casting or stacked plates 232 that includes a nose pin aperture 234 where a boom nose pin can be inserted to pivotally connect the excavator arm 160 to the boom 200.

Figure 3:
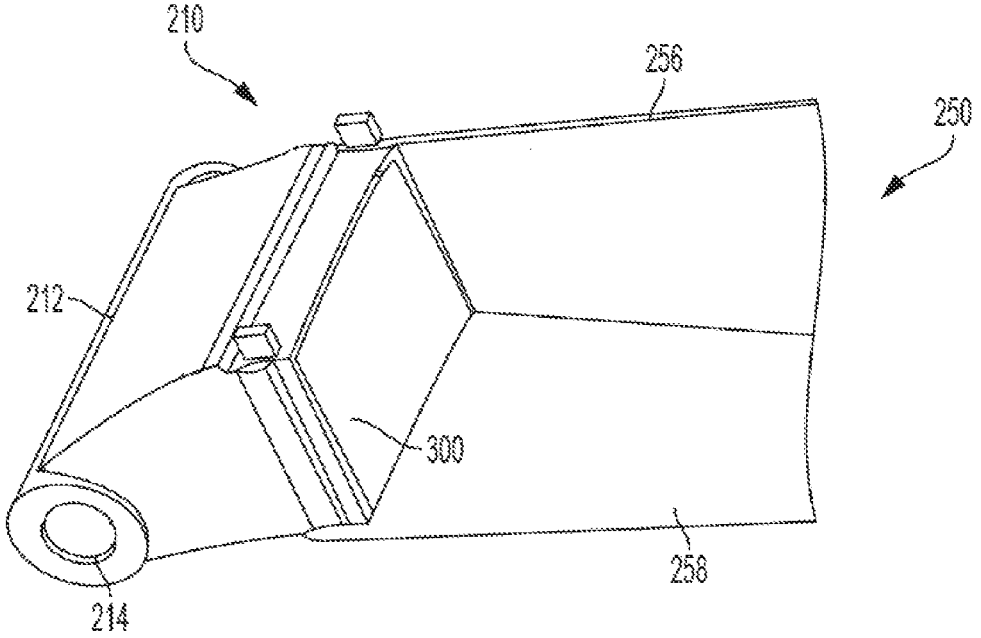
FIG. 3 PRIOR ART
FIG. 3 illustrates a closer view of the box section and boom foot section of FIG. 2 with the first side plate and top plate of the box section removed to show the interior of the box section.

The boom 200 further includes a box section 250 that extends between the boom foot section 210 and the boom center section 220. The box section 250 includes a first side plate 252, a top plate 254, a second side plate 256 and a bottom plate 258. FIG. 3 shows a closer view of the box section 250 and the boom foot section 210 with the first side plate 252 and top plate 254 removed to show the interior of the box section 250. The boom foot casting 212 transmits loads from the boom 200 to the frame 110 of the excavator 100 through the boom foot pin connection 214. The transition from the box section 250 to the boom foot pin connection 214 occurs over a very short distance. During corner digging and side loading of the bucket 170, large torsional loads are exerted at the connection between the box section 250 and the foot casting 212. These large torsional loads can cause twisting at the connection between the box section 250 and the foot casting 212 which, combined with high axial digging loads, can cause unwanted cracks in the welds at the connections between the side plates 252, 256 of the box section 250 and the foot casting 212.

One design to help resist this twisting and protect the boom is to add a separately welded bulkhead plate 300 (shown in FIG. 3) to the rear face of the foot casting 212. The bulkhead plate 300 is welded to the foot casting 210 and helps counteract twisting forces on the foot casting 210. Traditional boom foot designs can also include additional side sheets or "doublers" welded on the sides of the box section 250 that extend to cover the connection between the box section 250 and the foot casting 212.

Figure 4:
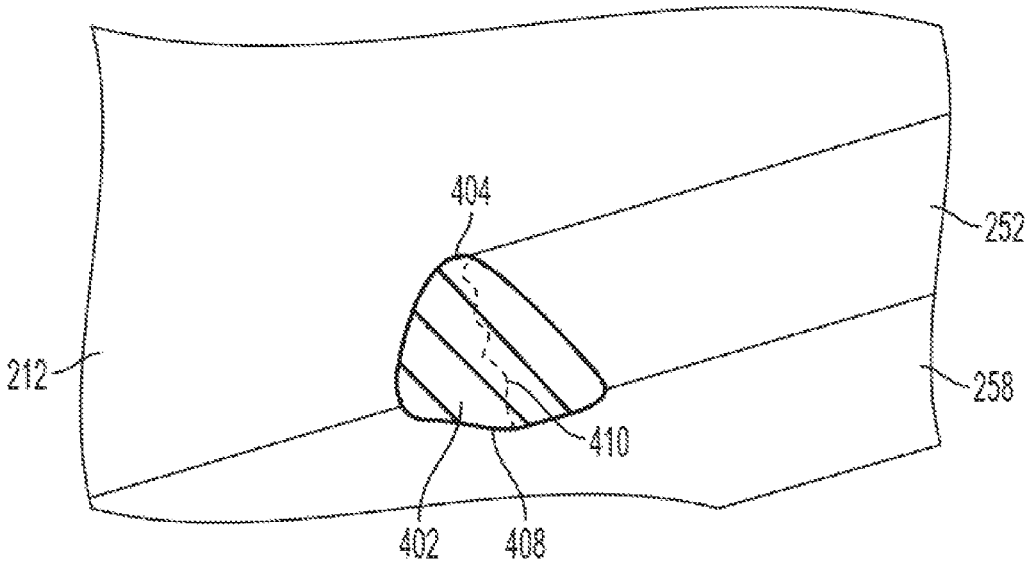
FIG. 4 PRIOR ART
FIG. 4 illustrates a cross section of a groove weld between the foot casting and the first side wall of the box section for the embodiment shown in FIGS. 2 and 3.

FIG. 4 illustrates a cross section of a groove weld 402 between the foot casting 212 and the first side wall 252 for the embodiment shown in FIGS. 2 and 3. The placement of the foot casting 212 and the first side wall 252 forms a V-groove and the groove weld 402 joins the foot casting 212 and the first side wall 252 along the V-groove. The groove weld 402 has a weld root 404 at the base of the V-groove, and a weld face 406 at the outer surface of the groove weld 402. The third side wall 256 is similarly welded to the other side of the foot casting 212. The first and third side walls 252, 256 are not welded to the top or bottom plates 254, 258 or to the bulkhead plate 300. The groove weld 402 is susceptible to cracks 410 that propagate from the weld root 404 towards the weld face 406. It is desirable to reduce or eliminate these cracks 410.

Figure 5:
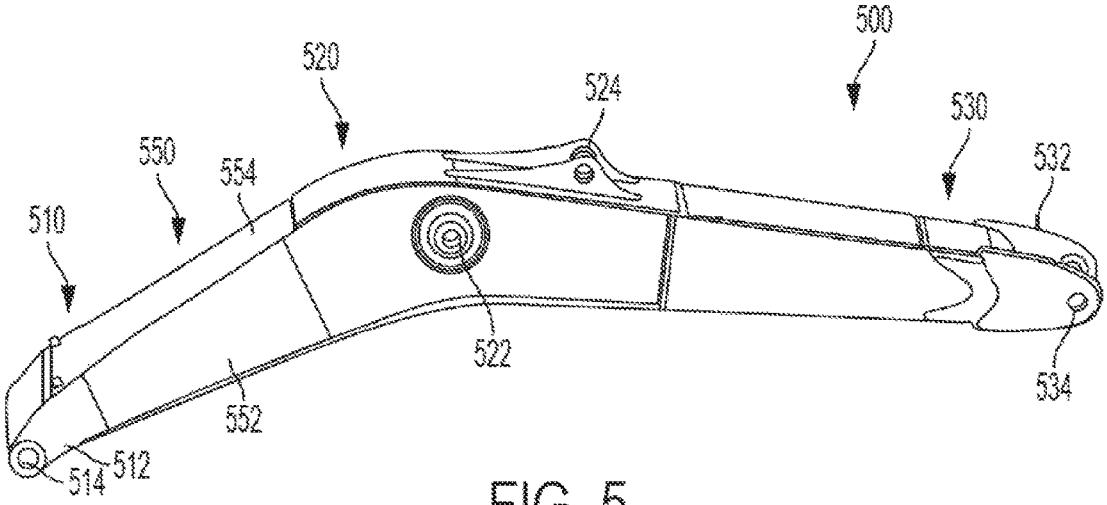
FIG. 5 illustrates an example of an improved excavator boom.

FIG. 5 shows an example of an improved excavator boom 500 that includes a boom foot section 510, a boom center section 520 and a boom nose section 530. The boom foot section 510 can include a boom foot casting 512 that includes a foot pin aperture 514 where a boom foot pin can be inserted to pivotally connect the boom 510 to the frame 110 of the excavator 100. The boom center section 520 can include a boom cylinder connection 522 for coupling the boom cylinder 152 to raise and lower the boom 500, and an arm cylinder connection 524 for coupling the arm cylinder 162 to raise and lower the excavator arm 160. The boom nose section 530 can include a nose casting 532 that includes a nose pin aperture 534 where a boom nose pin can be inserted to pivotally connect the excavator arm 160 to the boom 500.

Figure 6:
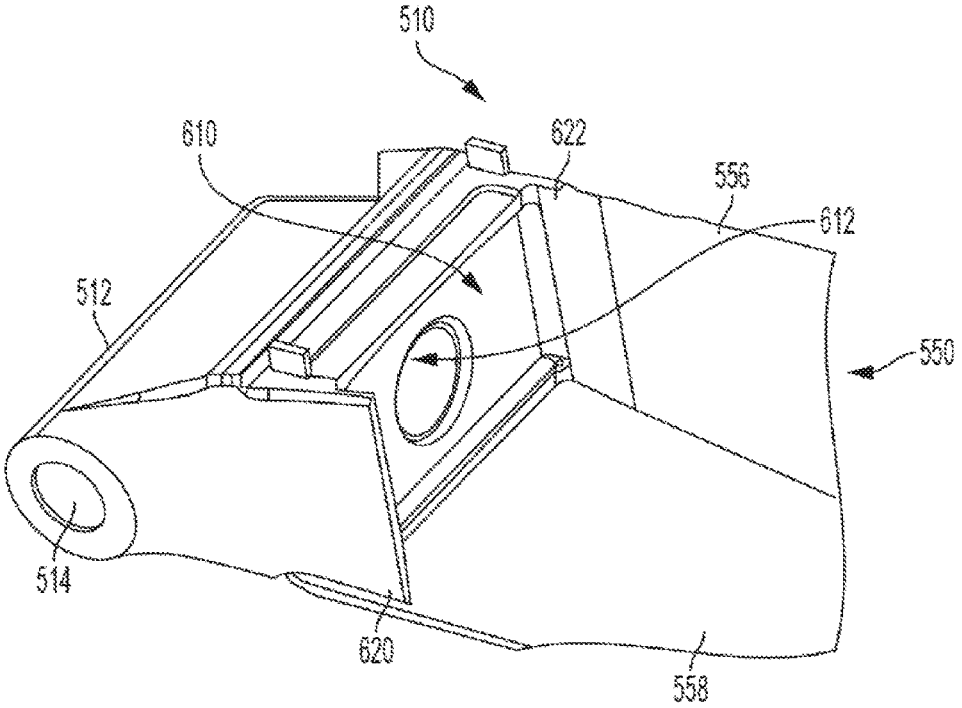
FIG. 6 illustrates a closer view of the box section and improved boom foot section of FIG. 5 with the first side plate and top plate of the box section removed to show the interior of the box section.

The boom 500 further includes a box section 550 that extends between the boom foot section 510 and the boom center section 520. The box section 550 includes a first side plate 552, a top plate 554, a second side plate 556 and a bottom plate 558. FIG. 6 shows a closer view of the box section 550 and the boom foot section 510 with the first side plate 552 and top plate 554 removed to show the interior of the box section 550. The boom foot casting 512 includes a bulkhead 610 and protruding double-beveled flanges 620, 622 that extend beyond the bulkhead 610 for coupling to the first and second side plates 552, 556, respectively. The bulkhead 610 and the protruding double-beveled flanges 620, 622 can be integrally cast or cast-in as part of the boom foot casting 512 so the entire piece (the boom foot casting 512, the foot pin aperture 514, the bulkhead 610 and the flanges 620, 622) is formed by a single piece of material. The integrally cast bulkhead 610 can include an aperture 612 that can be used for internal core removal from the boom foot casting 512. The aperture 612 can be circular and can be approximately 108 millimeters in diameter.

Figure 7:
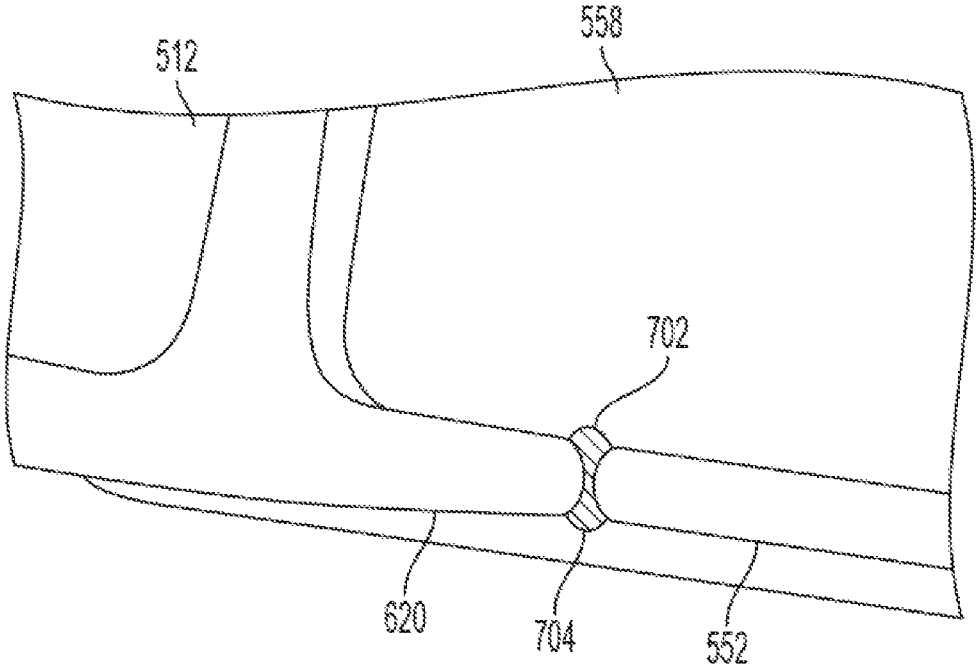
FIG. 7 illustrates a cross section of a double-beveled joint between the first protruding flange of the boom foot casting and the first side sheet of the improved boom.

FIG. 7 shows a cross-section view of the double-beveled joint between the first protruding flange 620 of the boom foot casting 512 and the first side sheet 552. A similar double-beveled joint is formed between the second protruding flange 622 of the boom foot casting 512 and the second side sheet 556. The double-beveled joint between the first protruding flange 620 and the first side sheet 552 enables groove welds 702, 704 on the interior and exterior of the joint which allows the first side sheet 552 to be fully fused to the boom foot casting 512, leaving no weld root from which a crack can originate (full fusion of the welded joint). Similarly, the double-beveled joint between the second protruding flange 622 and the second side sheet 556 enables groove welds on the interior and exterior of that joint which allows the second side sheet 556 to be fully fused to the boom foot casting 512, leaving no weld root from which a crack can originate.

The protruding flanges 620, 622 can extend beyond the bulkhead 610 to provide a less abrupt stiffness transition from the side sheets 552, 556 to the boom foot casting 512. The protruding flanges 620, 622 can extend beyond the bulkhead 610 to provide internal weld access for the internal groove welds 702 on both sides between side plates 552, 556 and the flanges 620, 622. The internal welds 702 and external welds 704 enable full fusion of the joints between side plates 552, 556 and the flanges 620, 622. The protruding flanges 620, 622 can extend beyond the bulkhead 610 to provide room for internal weld access for the internal groove welds 702 by a robot welder. Having the protruding flanges 620, 622 extend beyond the bulkhead 610 by approximately 80 millimeters has been found to provide adequate access, however other lengths can also be used. Full fusion of the joints between the side plates 552, 556 and the flanges 620, 622 can be achieved using the interior and exterior welds 702, 704, for example the V-grooves between the side plates 552, 556 and the flanges 620, 622 can be approximately 45 degrees with a small gap between the side plates 552, 556 and the flanges 620, 622. The gap between the side plates 552, 556 and the flanges 620, 622 can be approximately 2 millimeters. In an alternative embodiment, both the protruding flanges and the side plates have a 30 degree bevel creating a 60 degree opening for the V-groove.

This improved boom foot design has helped eliminate the cracks seen to originate from the weld root on current production booms. Traditional boom foot designs must use either thicker sections or external doublers at the boom foot, to lower stresses at the weld root to sufficiently slow crack propagation. The protruding flanges from the casting can enable weld gun access to perform the internal weld pass on the side sheets, which provides a stiffness transition region from the as-cast bulkhead area of the foot casting to the side sheet joint.

While the disclosure has been illustrated and described in detail in the drawings and foregoing description, such illustration and description is to be considered as exemplary and not restrictive in character, it being understood that illustrative embodiment(s) have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

I claim:

1. A boom foot section for a boom having a proximal end connected to a frame of a machine and a distal end connected to an arm, the boom including the boom foot section, a boom center section, a box section and a boom nose section, where the box section extends between the boom foot section and the boom center section, and the center section extends between the box section and the boom nose section which is configured to connect to the arm, the box section including first and second side walls, the boom foot section comprising:

a machine connection configured to connect the boom to the frame of the machine;

a bulkhead;

a first protruding flange; and a second protruding flange;

wherein the machine connection extends across the boom foot section between the first and second protruding flanges to form a proximal end of the boom foot section, the bulkhead extends across the boom foot section between the first and second protruding flanges to form a distal end of the boom foot section, and the first and second protruding flanges extend away from the machine connection beyond the bulkhead; and wherein the machine connection, the bulkhead, and the first and second protruding flanges define an interior of a boom foot casting; and wherein the first protruding flange is configured to be coupled to the first side wall of the box section of the boom and the second protruding flange is configured to be coupled to the second side wall of the box section of the boom.

2. The boom foot section of claim 1, wherein the machine connection, the bulkhead, and the first and second protruding flanges are integrally cast as a single piece of material to form the boom foot casting.

3. The boom foot section of claim 2, wherein the bulkhead includes an aperture that opens to the interior of the boom foot casting.

4. The boom foot section of claim 2, wherein the first protruding flange is coupled to the first side wall of the box section by a first weld joint, and the second protruding flange is coupled to the second side wall of the box section by a second weld joint.

5. The boom foot section of claim 4, wherein neither of the first weld joint or the second weld joint has a weld root.

6. The boom foot section of claim 5, wherein a first internal weld and a first external weld are fused to form the first weld joint between the first protruding flange and the first side wall of the box section, and a second internal weld and a second external weld are fused to form the second weld joint between the second protruding flange and the second side wall of the box section.

7. The boom foot section of claim 6, wherein the first and second protruding flanges extend beyond the bulkhead by 80 millimeters.

8. The boom foot section of claim 6, wherein the first protruding flange has a double-beveled edge used in the first weld joint for connection to the first side wall, and the second protruding flange has a double-beveled edge used in the second weld joint for connection to the second side wall.

9. A boom that extends from a machine to an arm, the boom comprising:

a boom foot section comprising a machine connection, a bulkhead, a first protruding flange, and a second protruding flange, the machine connection being configured to connect the boom to the machine;

a boom nose section configured to connect the boom to the arm;

a boom center section positioned between the boom foot section and the boom nose section; and a box section extending between the boom foot section and the boom center section, the box section including first and second side walls;

wherein the machine connection extends across the boom foot section between the first and second protruding flanges to form a proximal end of the boom foot section, the bulkhead extends across the boom foot section between the first and second protruding flanges to form a distal end of the boom foot section, and the first and second protruding flanges extend away from the machine connection beyond the bulkhead;

wherein the machine connection, the bulkhead, and the first and second protruding flanges define an interior of a boom foot casting; and wherein the first protruding flange is coupled to the first side wall of the box section of the boom and the second protruding flange is coupled to the second side wall of the box section of the boom.

10. The boom of claim 9, wherein the machine connection, the bulkhead, and the first and second protruding flanges of the boom foot section are integrally cast as a boom foot casting formed by a single piece of material.

11. The boom of claim 10, wherein the bulkhead includes an aperture that opens to the interior of the boom foot casting.

12. The boom of claim 10, wherein the first protruding flange is coupled to the first side wall of the box section by a first weld joint, and the second protruding flange is coupled to the second side wall of the box section by a second weld joint.

13. The boom of claim 12, wherein neither of the first weld joint or the second weld joint has a weld root.

14. The boom of claim 13, wherein a first internal weld and a first external weld are fused to form the first weld joint between the first protruding flange and the first side wall of the box section, and a second internal weld and a second external weld are fused to form the second weld joint between the second protruding flange and the second side wall of the box section.

15. The boom of claim 14, wherein the first and second protruding flanges extend beyond the bulkhead by 80 millimeters.

16. The boom of claim 14, wherein the first protruding flange has a double-beveled edge used in the first weld joint for connection to the first side wall, and the second protruding flange has a double-beveled edge used in the second weld joint for connection to the second side wall.

17. The boom of claim 16, wherein the first side wall has a double-beveled edge used in the first weld joint, and the second side wall has a double-beveled edge used in the second weld joint; the double-beveled edges of the first side wall and the first protruding flange forming a first interior V-groove and a first exterior V-groove, the first weld joint being formed in the first interior V-groove and the first exterior V-groove, and the double-beveled edges of the second side wall and the second protruding flange forming a second interior V-groove and a second exterior V-groove, the second weld joint being formed in the second interior V-groove and the second exterior V-groove.

18. The boom of claim 17, wherein the first weld joint comprises a first groove weld formed in the first interior V-groove and a second groove weld formed in the first exterior V-groove, the first and second groove welds being fused to form the first weld joint, and wherein the second weld joint comprises a third groove weld formed in the second interior V-groove and a fourth groove weld formed in the second exterior V-groove, the third and fourth groove welds being fused to form the second weld joint.

* * * * *